US006035929A

United States Patent [19]

Friedel et al.

[11] Patent Number: 6,035,929

[45] Date of Patent: Mar. 14, 2000

[54] APPARATUS FOR HEATING OR COOLING A CIRCULAR HOUSING

[75] Inventors: Jérôme Friedel, Blandy les Tours; Daniel Jean Marey, Soisy sur Seine, both of France

[73] Assignee: Societe Nationale d'Etude et de Construction de Moteurs d'Aviation "SNECMA", Paris, France

[21] Appl. No.: 09/115,523

[22] Filed: Jul. 15, 1998

[30] Foreign Application Priority Data

Jul. 18, 1997 [FR] France ..... 97 09136

[51] Int. Cl.[7] ..... F01D 11/24; F28F 3/12

[52] U.S. Cl. ..... 165/168; 415/116; 415/173.2; 415/175; 415/176; 415/178

[58] Field of Search ..... 165/168, 169; 415/115, 116, 117, 173.1, 173.2, 175, 176, 178

[56] References Cited

U.S. PATENT DOCUMENTS

| | | | |
|---|---|---|---|
| 3,408,044 | 10/1968 | Burger . | |
| 5,100,291 | 3/1992 | Glover | 415/177 |
| 5,205,115 | 4/1993 | Plemmons et al. | 415/173.1 |
| 5,281,085 | 1/1994 | Lenahan et al. | 415/178 |

FOREIGN PATENT DOCUMENTS

| | | | |
|---|---|---|---|
| 0 541 325 | 5/1993 | European Pat. Off. . | |
| 0 559 420 | 9/1993 | European Pat. Off. . | |
| 63-154806 | 6/1988 | Japan | 415/173.2 |
| 2108586 | 5/1983 | United Kingdom | 415/116 |
| 2136508 | 9/1984 | United Kingdom | 415/173.1 |

*Primary Examiner*—Christopher Verdier
*Attorney, Agent, or Firm*—McClelland Maier & Neustadt, P.C.

[57] ABSTRACT

A heating or cooling apparatus for a turbo-machine housing collar that adjusts the diameter of the housing using chambers that are arcs of a circle through which gas is blown onto the ribs of the housing. The gas circulates in a counterflow direction or in alternate directions for adjacent chambers in order to equalize the blowing conditions at every paint of the ribs.

5 Claims, 2 Drawing Sheets

APPARATUS FOR HEATING OR COOLING A CIRCULAR HOUSING

BACKGROUND OF THE INVENTION

1. Field of the Invention

The present invention relates to an apparatus for heating or cooling a circular housing.

2. Discussion of the Background

The housings of turbo-machines are cooled or heated, as appropriate, by standard means that adjust their diameter by dilating or contracting them under the influence of heat. It is therefore possible to accurately adjust the play between the housing and the rotor that it covers, especially at the ends of the rotating blades of the rotor, in order to reduce gas leakage which escapes through the play and reduces the machine's efficiency. Another advantage of this arrangement, which only exists however when using cold gas, is that it avoids overheating the housing and the apparatus that it supports or that are adjacent to it. In any event, the gas is taken under pressure from another area of the machine and is blown onto the outer surface of the housing at a rate that can be constant or monitored according to the speed of the motor. In some designs the gas is blown directly onto the outer surface of the housing. In other configurations, such as French patent 2 688 539 filed by the same applicant, the housing is stiffened by circular ribs on the outer surface and the gas is blown mainly onto these ribs, although some gas can also be blown directly onto the housing. Blowing on the ribs is advantageous as it uses a larger thermal exchange surface area, thereby quickening thermal distortion of the housing.

SUMMARY OF THE INVENTION

Given that one of the main aims of the present gas blowing apparatus is to finely adjust the degree of play between the housing and the rotating blades, the distortion of the housing must be very precisely controlled. Yet it may be noted that the irregularity of blowing on the surface of the housing and the ribs produces variations of distortion which are in opposition to the present aim. This is why the object of the present invention is to design a gas blowing system that produces uniform heating or cooling of the outer surface of housing that is provided with stiffening ribs.

A series of blowing chambers is used, located in succession in front of the ribs and lying parallel to the ribs and provided with apertures that open onto the ribs and that are supplied by a gas distribution network. Furthermore, the ribs have two different chambers lying on either side of them and the distribution network is connected to the adjacent chambers by sections facing each other along the chambers. Thus, flows in alternate directions are produced within the chambers and all the ribs receive gas relatively close to the distribution network on one of their surfaces, and gas relatively distant on the opposite surface. The temperature of the first of these gas flows varies less strongly than the second because it spends less time in the chamber through which it has flowed. But as the average travel length of the two gas flows is identical no matter which part of the ribs is considered, the resulting heating or cooling is uniform over the entire length of the rib, and the aim of the invention in thus achieved.

An essential and characteristic feature of the present invention is that the gas distribution network consists of pipes of identical, or substantially identical, total length that have a starting-point that is common to every chamber by means of carefullylocated ramifications. All the gas flow is therefore subject to equal temperature variations before it arrives in the chambers and thus completes the equalizing effect produced by circulating in opposite directions in the adjacent chambers.

BRIEF DESCRIPTION OF THE DRAWINGS

The accompanying drawings which are incorporated in and constitute a part of this specification, illustrate embodiments of the present invention and, together with the description, serve to explain the principles of the present invention; in which.

DETAILED DESCRIPTION OF THE PREFERRED EMBODIMENTS

Figure 1:
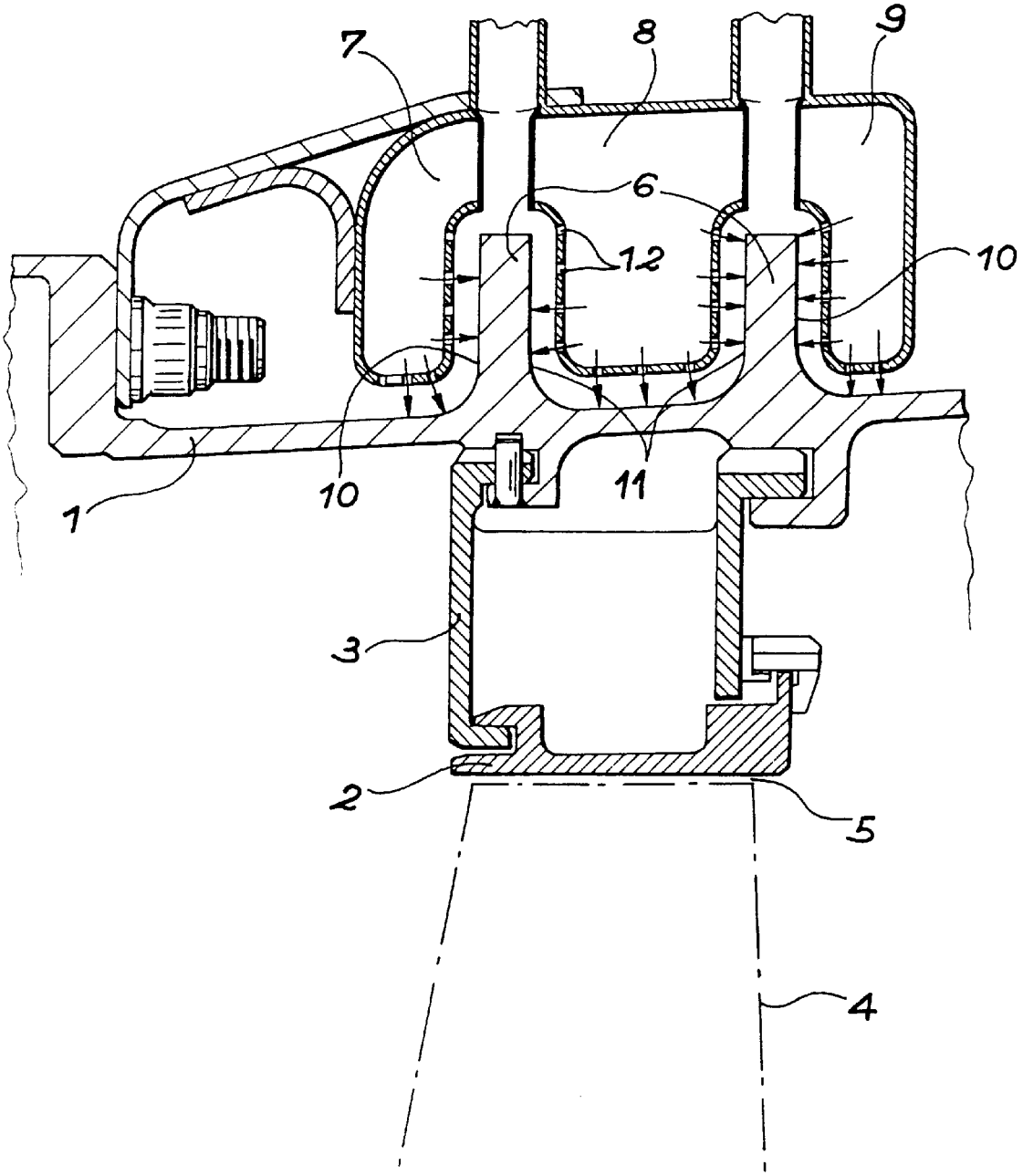
FIG. 1 is a local transversal section through the housing and the blowing apparatus.

The housing illustrated in FIG. 1 is indicated by reference numeral 1. It is provided with segments of a collar 2 which are connected to it by spacers 3 and located at a short distance from the rotor rotating blades 4, with play 5 up to the free ends of the blades. It is the width of the play 5 which must be adjusted and reduced. The housing 1 is also provided with ribs 6 on its outer surface that lie in front of the spacers 3. The section of the gas-blowing apparatus which can be seen in FIG. 1 comprises three chambers 7,8 and 9 (also known as ramps in this field) of which the first and the last lie next to one of the respective ribs 6, in front of their outer surface 10, and the second chamber 8 is an intermediary chamber between the two others and lies between the two ribs 6 in front of their inner surface 11. All the chambers 7,8 and 9 are provided with apertures 12 that open onto the ribs 6 in front of which they are located. The gas leaves chambers 7,8 and 9 by the apertures and is blown onto ribs 6 and the adjacent sections of housing 1. It then flows next to or between the succession of chambers 7,8 and 9 towards the outside.

Figure 2:
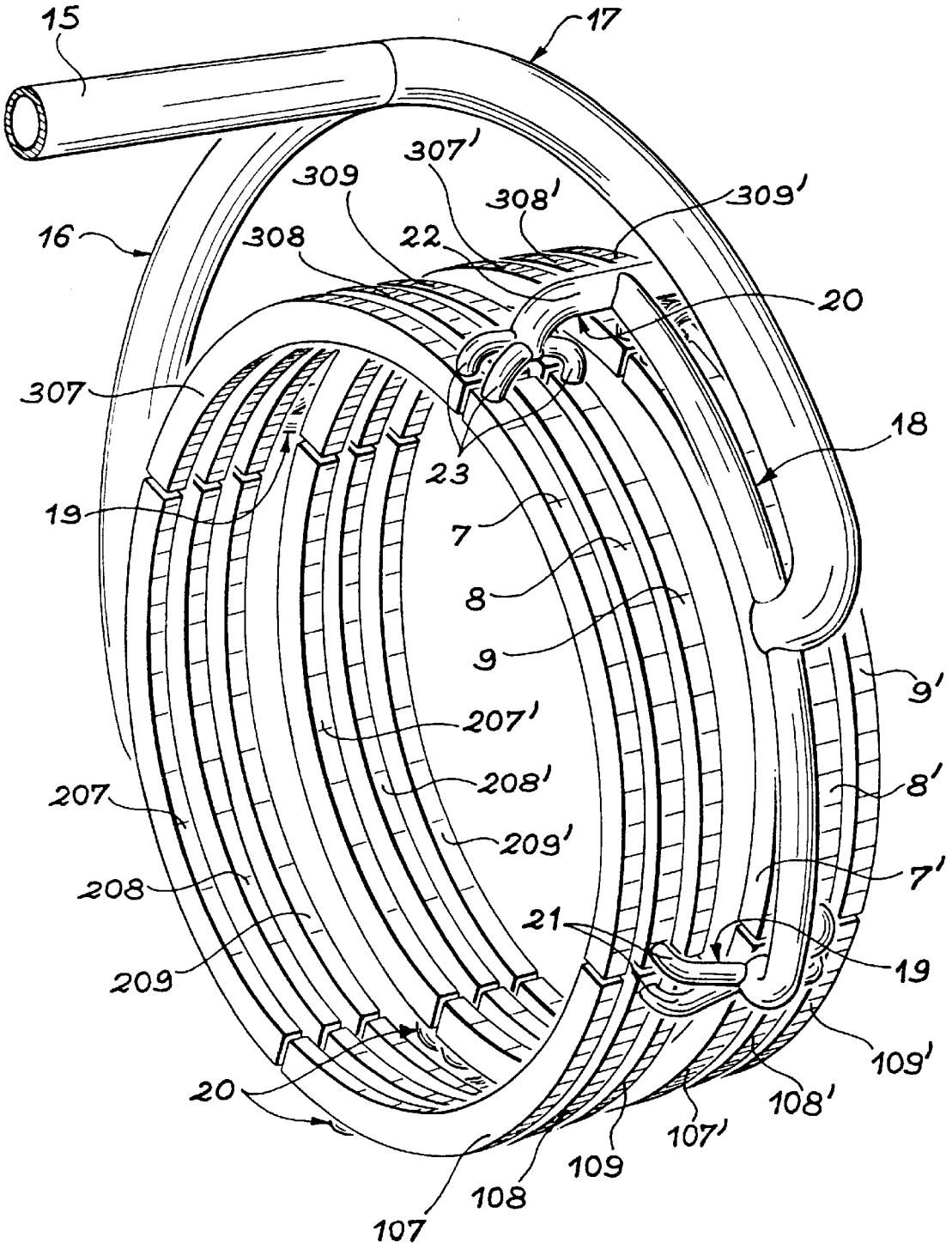
FIG. 2 is an overall view of the blowing apparatus.

The heating apparatus is shown as a whole in FIG. 2, the housing 1 being omitted. The distribution chambers 7,8 and 9 each extend over a quarter of the circumference and are followed by other groups of three identical chambers 107, 108, 109, 207, 208, 209 and 307, 308, and 309, thus forming a triple collar around housing 1 and ribs 6. Moreover, this embodiment comprises an identical blowing apparatus for another section of housing 1 that also comprises two ribs, located next to those that have just been described, thus explaining that four other groups of three identical chambers 7', 8', 9', 107', 108', 109', 207', 208', 209', 307', 308', and 309' are arranged in the same way.

The distribution network firstly comprises a common pipe 15 with several ramifications to supply all the chambers. It first divides into two second-caliber pipes 16 and 17, each of which covers a quarter of the circumference of the housing 1 and finish at half-length in certain chambers (7, 8, 9, 7', 8', 9' and 207, 208, 209, 207', 208' and 209'). At this point they each ramify into two third-caliber pipes 18 that cover, up to one of their ends, one eighth of the circumference of housing 1 in front of the chambers mentioned above. They open into distributors 19 and 20 that are located in front of the ends of the chambers and are used to send the blown gas into the chambers. One of the distributors 19 comprises four pipes 21 arranged in an X shape, leading to the end of third-caliber pipe 18 and connecting to the outer surface of intermediary chambers 8, 108, 8', and 108'. The other distributor 19 (not seen in FIG. 2 but similar to the first) connects to chambers

208, 208', 308 and 308'. The distributors 20 (also similar to one another) are slightly more complex and initially comprise ramification pipes 22 that run from the end of third-caliber pipe 18 in opposite axial directions and finish in connecting pipes 23 arranged in an X shape like pipes 21 and which connect to the outer walls of end chambers 7, 307, 9 and 309, 7', 307', 9' and 309', 107, 207, 109 and 209, and 107', 109', 207' and 209'.

The blowing gas circulates in the end chambers, 7 and 9 for example, of each of the groups of three in the opposite direction to direction of flow in the intermediary chamber 8. If, for example, the gas blown is cool gas having the effect of cooling a very hot structure, it is subject to considerable heating throughout the distance it covers in contact with the surfaces of the pipes and the chambers, especially in the chambers which are very close to the housing 1.

The gas that is blown through the apertures 12 near the distribution pipes 21 or 23 is therefore cooler and more efficient than the gas which leaves the opposite end of chambers 7, 8, and 9. Counterflow circulation is used to blow gas on every point of the ribs 6. The gas is as cold on the outer surface 10 as the gas blown on the inner surface 11 in the same place, is hot. Cooling is therefore uniform along the ribs 6 providing the two flow rates are the same everywhere. The distribution network must therefore be designed to meet this requirement. One solution is to divide the network into equal pipe sections at each ramification, the directions of which form the same angle with that of the pipe that is ramified. The flow is thus symmetrical and is equally distributed among the ramified pipes. In the embodiment illustrated, it may be noted that the ramifications are T-shaped, the trajectory taken by the gas is at a right angle from one pipe to the next and the ramified pipes are aligned opposite one another. What is more, the intermediary chambers 8, that supply two ribs 6, have a transversal cross-section that is twice as wide as the end chambers 7 and 9 and the flow rate is in proportion to the dimensions i.e. double the flow rate. This is achieved simply because the distribution network is ramified one time less towards intermediary chambers 8 than towards end chambers 7 and 9 as the ramification pipes 22 are omitted. Finally, the gas arrives in chambers 7, 8 and 9 etc. after covering almost identical distances in the distribution network pipes with a common starting point; line 15, for example, to chambers 7, 8, 9 etc., which further equalizes the heating of the chambers. As has already been seen, the network is constructed with ramifications that have been designed so that all the pipes that end in a common ramification, or in a ramification of the same caliber, are of the same length. Only the distributors 19 and 20 are slightly different but as they are all short, they make no noticeable difference to the overall equality of length. The basic concepts behind the invention may easily be applied to other numbers and other rib configurations and to other angular chamber extensions that differ by a quarter turn.

What is new and desired to be secured by Letters Patent of the United States is:

We claim:

1. An apparatus for heating or cooling a circular housing provided with circular outer ribs, the apparatus comprising a succession of chambers located in front of and parallel to the ribs and provided with apertures opening onto one of two main sides of at least one of the ribs, the two main sides of each of the ribs respectively being supplied with gas through the apertures of successive ones of the chambers, and a gas distribution network comprising bifurcating pipes leading from a common starting point to connections with the chambers which are located at alternating opposite ends of the chambers, wherein lengths of the pipes measured from the common starting point to each of the connections with the chambers are all equal.

2. The apparatus of claim 1, wherein the gas distribution network bifurcates according to ramifications in T-shaped right angles.

3. The apparatus of claim 1, wherein said pipes have, downstream of bifurcations of the gas distribution network, respective cross-sections which are proportional to a cross-section of one of the chambers to which said pipes lead respectively.

4. The apparatus of claim 1, wherein said pipes have, downstream of bifurcations of the gas distribution network, respective cross-sections which are proportional to an overall cross-section of a group of the chambers to which said pipes lead respectively.

5. The apparatus of claim 1, wherein the chambers are composed of intermediate chambers located between two of the ribs and provided with apertures opening onto said two ribs, and the chambers are composed of end chambers located next to one of the ribs, the end chambers having a cross-section which is half the cross-section of the intermediate chambers.

* * * * *